US007293673B2

(12) United States Patent
Savage et al.

(10) Patent No.: US 7,293,673 B2
(45) Date of Patent: Nov. 13, 2007

(54) DRAWER ITEM DISPENSER

(75) Inventors: Kent V. Savage, Morrow, OH (US); William K. Holmes, San Diego, CA (US); Charles A. Tyack, San Diego, CA (US)

(73) Assignee: SupplyPro, Inc., San Diego, CA (US)

( * ) Notice: Subject to any disclaimer, the term of this patent is extended or adjusted under 35 U.S.C. 154(b) by 215 days.

(21) Appl. No.: 11/106,355

(22) Filed: Apr. 14, 2005

(65) Prior Publication Data

US 2006/0049200 A1 Mar. 9, 2006

Related U.S. Application Data

(63) Continuation-in-part of application No. 10/936,332, filed on Sep. 8, 2004, now Pat. No. 7,142,944.

(51) Int. Cl.
*B65H 1/00* (2006.01)

(52) U.S. Cl. ..... 221/122; 221/121; 221/120; 221/119; 221/246

(58) Field of Classification Search ..... 221/122, 221/121, 120, 119, 246
See application file for complete search history.

(56) References Cited

U.S. PATENT DOCUMENTS

| | | | | |
|---|---|---|---|---|
| 5,087,107 | A | 2/1992 | Fumanelli | |
| 5,392,951 | A | 2/1995 | Gardner et al. | |
| 5,445,294 | A | 8/1995 | Gardner et al. | |
| 5,661,978 | A | 9/1997 | Holmes et al. | |
| 5,716,114 | A | 2/1998 | Holmes et al. | |
| 5,745,366 | A | 4/1998 | Higham et al. | |
| 5,883,806 | A | 3/1999 | Meador et al. | |
| 5,905,653 | A | 5/1999 | Higham et al. | |
| 5,927,540 | A | 7/1999 | Godlewski | |
| 5,940,306 | A | 8/1999 | Gardner et al. | |
| 6,011,999 | A | 1/2000 | Holmes | |
| 6,065,819 | A | 5/2000 | Holmes et al. | |
| 6,109,774 | A | 8/2000 | Holmes et al. | |
| 6,116,461 | A | 9/2000 | Broadfield et al. | |
| 6,175,779 | B1 | 1/2001 | Barrett | |
| 6,338,007 | B1 | 1/2002 | Broadfield et al. | |
| 6,367,653 | B1 | 4/2002 | Ruskin et al. | |
| 6,385,505 | B1 | 5/2002 | Lipps | |
| 6,631,825 | B2 * | 10/2003 | Garrant et al. | 221/79 |
| 6,658,322 | B1 | 12/2003 | Frederick et al. | |
| 6,811,232 | B2 | 11/2004 | Doan et al. | |

FOREIGN PATENT DOCUMENTS

| | | |
|---|---|---|
| GB | 12590 | 3/1913 |

* cited by examiner

*Primary Examiner*—Gene O. Crawford
*Assistant Examiner*—Timothy Waggoner
(74) *Attorney, Agent, or Firm*—Michael Best & Friedrich LLP

(57) ABSTRACT

A dispensing system for dispensing items. The system includes a base that has first and second compartments. The base can rotate about an axis. An item can be stored in one of the first and second compartments. The system also includes a cover that covers the base, the first compartment, and the second compartment. Furthermore, the cover has an opening. The system also includes a handle that is coupled to the cover. The handle can be used to actuate the cover to rotate about the axis to align the opening with one of the first and second compartments. The system also includes an ejector that ejects the item from the compartment when the handle aligns the ejector with the opening.

17 Claims, 6 Drawing Sheets

DRAWER ITEM DISPENSER

RELATED APPLICATIONS

This patent application is a continuation-in-part of prior application Ser. No. 10/936,332, filed on Sep. 8, 2004 now U.S. Pat. No. 7,142,944. The entire disclosure of the application is considered as being part of the accompanying application.

BACKGROUND

Embodiments of the invention relate to storage cabinets, and particularly to multi-compartment storage cabinets. More particularly, embodiments of the invention relate to storage cabinets having a matrix of dispensing modules.

Storage cabinets are typically used in factories, shops, plants, stores or other sites to store small tools, parts, ingredients or other items. The cabinets allow for better organization and space utilization, while simultaneously improving worker productivity by eliminating time wasted looking for items.

Typical cabinets of the type described herein are often used to store consumables or small parts that are commonly used within a particular factory or shop. Because these parts are purchased and stored in bulk, accurate inventory and costing of the products made using these parts is difficult. In addition, misappropriation of the parts is difficult to detect or prevent.

In other situations, the use of a cabinet is desirable, however, due to the nature of the items to be placed in the cabinet, security precludes their use. For example, expensive and dangerous elements such as diamond drill bits may be needed to assemble a tool such as a drill. However, diamond drill bits are too expensive to allow uncontrolled access within a factory. Therefore, the components necessary to make a complete switch may not be securely stored within a cabinet. Instead, the materials are typically stored in a remote secure location that requires the worker to waste time and effort retrieving them. To save time and to reduce the number of trips to the remote secure location, workers often request excessive materials resulting in an increase in wasted material, time, and risk.

SUMMARY

In one embodiment, the invention provides a dispensing system for dispensing items. The system includes a base that has first and second compartments. The base can rotate about an axis. An item can be stored in one of the first and second compartments. The system also includes a cover that covers the base, the first compartment, and the second compartment. Furthermore, the cover has an opening. The system also includes a handle that is coupled to the cover. The handle can be used to actuate the cover to rotate about the axis to align the opening with one of the first and second compartments. The system also includes an ejector that ejects the item from the compartment when the handle aligns the ejector with the opening.

In another embodiment, the invention provides a dispensing system for dispensing items. The system includes a drawer and a plurality of dispensing modules that are positioned within the drawer. Furthermore, each of the dispensing modules is configured to hold at least one item. The system also includes a handle coupled to one of the dispensing modules. The handle can be used to release one of the items from the dispensing module when actuated and to lock in the items in the dispensing module when left idle.

In another embodiment, the invention provides a dispensing system for dispensing items. The system includes a drawer that has a bottom. The bottom defines a substantially horizontal plane. The system also includes a dispensing module that is positioned in the drawer, and a base that is positioned in the dispensing module. The base has first and second compartments. The base is rotatable about an axis that is parallel to the plane. The first and second compartments can be used to store items. The system can also include a cover to cover the dispensing module thereby covering the first and second compartments. The cover also has an opening. The system can also include a handle that is coupled to the dispensing module to actuate the base. The base can rotate about the axis to align one of the first and second compartments with the opening. An ejector then ejects the item from the dispensing module when the handle is actuated. However, the ejector locks the dispensing modules in the drawer when the handle is left idle.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

As should also be apparent to one of ordinary skill in the art, the apparatus shown in the figures are models of what actual systems might be like. As noted, many of the modules, structures and functions described are capable of being implemented in software executed by a microprocessor or a similar device or of being implemented in hardware using a variety of components including, for example, application specific integrated circuits ("ASICs"). Terms like "processing unit" may include or refer to both hardware and/or software. Furthermore, throughout the specification capitalized terms are used. Such terms are used to conform to common practices and to help correlate the description with the examples, and/or drawings. However, no specific meaning is implied or should be inferred simply due to the use of capitalization. Thus, the claims should not be limited to the specific examples or terminology or to any specific hardware or software implementation or combination of software or hardware.

Embodiments of the invention relate to a dispensing system for dispensing items. In one embodiment, the invention includes a dispensing system that includes a plurality of dispensing modules. Each of the dispensing modules has a base that can rotate about an axis and can be used to store an item to be ejected from the dispensing module when a handle is actuated.

In a specific embodiment, the dispensing module includes a cassette to store a plurality of items. The cassette has a base and a cover. Once an item has been selected at a control center, the dispensing module that contains the selected item is illuminated with indicators. A user then actuates a handle to release the selected item from the cassette.

Figure 1:
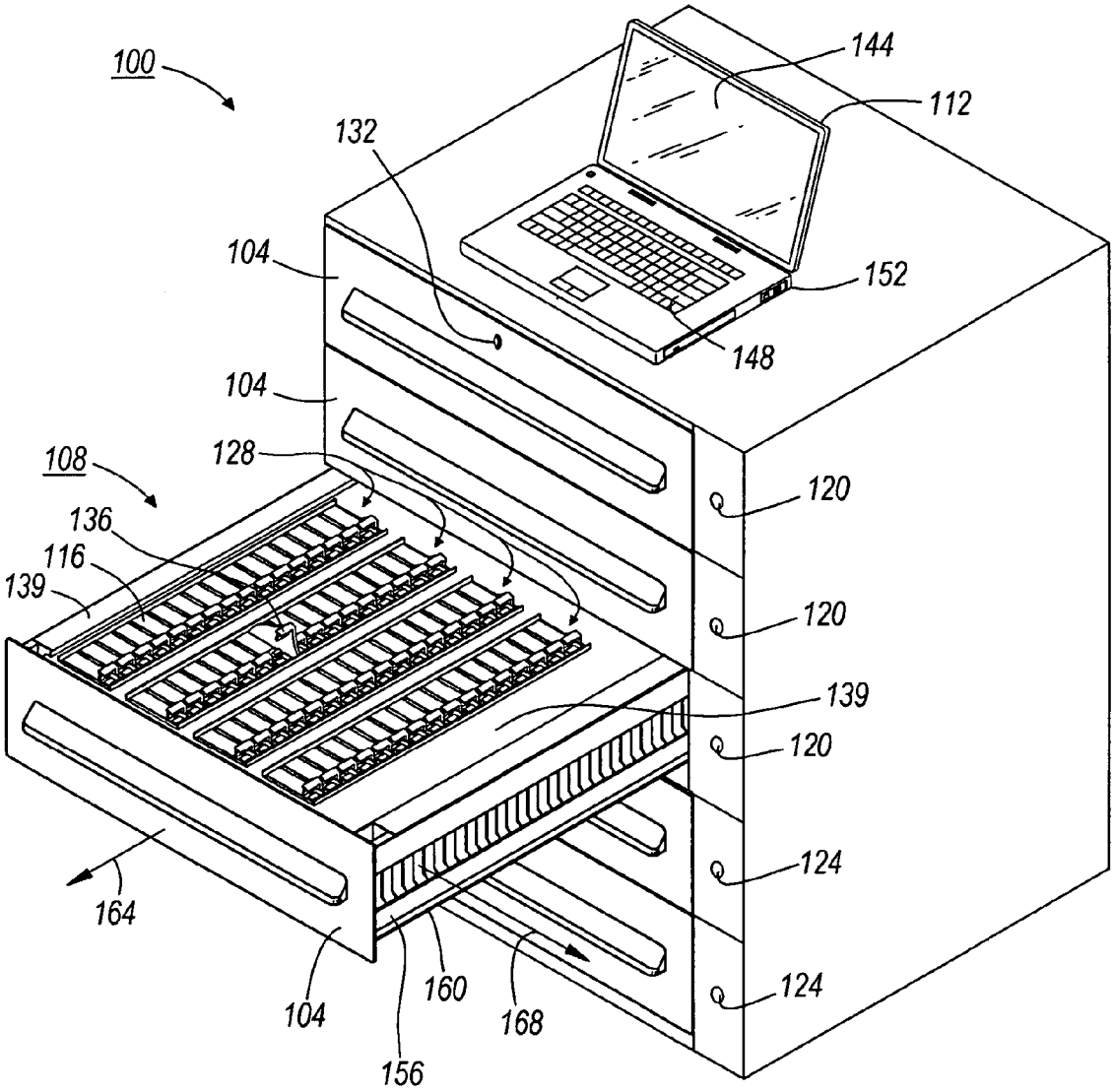
FIG. 1 is a perspective view of a cabinet including a plurality of dispensing modules embodying the invention.

FIG. 1 illustrates a cabinet 100 having a plurality of drawers 104 adapted to store items and fitted with a kit 108 of the invention. The kit 108 includes a control center 112, a plurality of dispensing modules 116, and a plurality of indicators 120. The indicators 120 are generally light emitting diodes ("LED") that illuminate to aid a user in finding the desired item. For example, the cabinet 100 of FIG. 1 includes a plurality of drawer LED's 124 positioned vertically down the front of the cabinet 10 adjacent the drawers 104. One LED 124 is positioned adjacent each drawer 104. When the user requests an item, the LED 124 corresponding to the drawer 104 that contains the item is illuminated to quickly guide the user to the proper drawer. Mechanisms of the cabinets and the dispensing modules 116 are configured to be resistant to tampering or intentional or unintentional jamming of the dispensing modules 116 or the cabinet 100. In some embodiments, the mechanisms are fastened together with special fasteners that are either rivets or tamper-resistant fasteners requiring a special tool for removal. The cabinet 100, the drawers 104, and the dispensing modules 116 also include a plurality of locking mechanisms. The locking mechanisms can be unlocked by the user via the control center 112 when a dispensing process in which an item is dispensed from the dispensing module 116 is started by the user, as will be discussed below.

The term "item" as used herein includes any physical thing that may be used by a user. Items include but are not limited to parts, tools, chemicals, substances, inserts, food ingredients, measuring instruments, fixtures, jigs, consumables, returnables, and the like. In addition, terms such as "tool" or "part" may be used to describe specific examples of uses of a cabinet as described herein, however, these terms should not be read as limiting the cabinets use to tools or parts. Instead, the terms "tool" and "part" may be read broadly to include any physical item.

The cabinet 100 is similar to many cabinets currently used in industry worldwide. For example, Stanley-Vidmar, of Allentown Pennsylvania, sells a cabinet under model number SEP2025AL that is similar to the cabinet 100 illustrated in FIG. 1. For another example, Lista AG, of Erlen, Switzerland also sells a cabinet that is similar to the cabinet 100 illustrated in FIG. 1. In the illustrated embodiment, the cabinet 100 includes five drawers 104, with more or less drawers 104 being possible. In addition, each drawer 104 is subdivided into a plurality of columns 128. For example, the drawer 104 shown in the open position in FIG. 1 is subdivided into four columns 128. Still other constructions may employ more or less than four columns 128. The walls subdividing the drawers 104 are often movable to allow the user to configure the columns 128 as necessary for a particular use. Although the columns 128 shown in FIG. 1 are arranged in parallel, the columns 128 can also be arranged in the drawer 104 in other configurations. For example, some of the columns 128 can be arranged in parallel while other columns 128 can be arranged perpendicular to the parallel columns 128. Each of the columns 128 shown in FIG. 1 contains sixteen dispensing modules 116. Each of the dispensing modules 116 includes a handle 136 that locks the dispensing module 116 in place, as will be further detailed below. In the embodiment shown in FIG. 1, the dispensing modules 116 are optionally held in the columns 128 of the drawer 104 with a bracket 139. A different bracket is used if the columns 128 are arranged differently. In some embodiments, the handle 136 can be equipped with a LED or some indicator therein. As a result, the handle 136 can be lighted when activated or actuated, and can be used as an item indicator. Furthermore, the bracket 139 can trimmed or adjusted to accommodate different drawer sizes.

It should be noted that while the term cabinet is used throughout the description to describe the shown embodiment, the term cabinet should not be read as limiting the invention. For example, other constructions secure the contents of single individual drawers built into walls or other structures. In another construction, the invention is built into a mechanic's van to aid in the location of items therein. In still another construction, the kit 108 of the invention protects the contents of a mechanic's mobile cabinet. As one having ordinary skill in the art will realize, the invention is capable of securing the contents within any compartment and is capable of guiding the user to the correct column 128 no matter what supports the column 128. Therefore, the invention should not be limited to cabinets alone.

Referring back to FIG. 1, each drawer 104 has a bottom 156 that defines a bottom plane 160. The dispensing modules 116 are generally arranged along one of a plurality of axes 164 that are substantially parallel to the bottom plane 160. As shown in FIG. 1, the axes 164 and the columns 128 of the dispensing modules 116 are arranged in parallel. However, in some other embodiments, the dispensing modules 116 can also be configured to be arranged along one of a plurality of second axes 168 that are also parallel to the bottom plane 160 of the drawer 104 in a row format instead of the column format as shown in FIG. 1. That is, the dispensing modules 116 in the row format are arranged along the second axes 168 that are substantially perpendicular to the dispensing modules 116 shown in the column format in FIG. 1.

Each drawer 104 can slide into and out of the cabinet 100 to provide the user with access to the parts, tools, or other items stored within the drawers 104. In some cabinets 100, a lock mechanism 132 allows the user to lock all of the drawers 12, thereby preventing unwanted removal of the contents of the cabinet 100. Many lock mechanisms 132 are available that secure the drawers 104 of cabinets 100. FIG. 1 illustrates a lock mechanism 132 that includes a key that moves two bars (not shown) into engagement with a mechanism that prevents the drawers 104 from opening. A still simpler device includes an L-shaped piece (not shown) connected to the cabinet at a hinge. The L-shaped piece covers a portion of the drawers when in the locked position to prevent their opening. Other constructions employ a solenoid-actuated lock that locks all of the drawers. The solenoid-actuated lock may include a single solenoid capable of locking or unlocking all of the drawers or may include multiple solenoids, each capable of locking or unlocking one or more of the drawers.

The illustrated cabinet 100 is stationary; that is, it is placed directly on a floor or onto another cabinet within a factory, shop, or storage area. Other constructions include cabinets 100 placed on castors or wheels to provide mobile sources of items. In the case of a mobile cabinet, a mobile power supply may be included with the kit 108 to allow the cabinet to be positioned remote from a power supply.

The control center 112 shown in FIG. 1 generally houses a video display 144, a processing unit, a memory device, and a data storage device. The control center 112 also includes a keyboard 148, and an identification device 152. Although the identifying device 152 shown in FIG. 1 is integrated into the control center 112, the identifying device 152 can be a peripheral device. In some embodiments, the identifying device 152 can include a card reader, a biometric reader, and the like.

The control center 144 runs a program that both regulates access to the components within the cabinet 100 and maintains an accurate inventory of the items within the cabinet 100. Furthermore, the program can monitor the rate of use of specific components, the length of time the items have been in a particular dispensing module 116, and the user or users accessing the cabinet 100. Generally, the program is stored on the data storage device of the control center 112 for execution by the processing unit and the memory device. However, other constructions may employ a program that is stored in a remote location, such as a server, and is downloaded when needed. Still other constructions may employ a "dumb" display terminal that simply displays a program that is executed at a remote location. Further, the control center 112 is shown on top of the cabinet 100. However, the control center 112 may be remote from the cabinet 100 and may be wirelessly linked to the cabinet 100. Also, as mentioned, the control center 112 can be used to monitor many parameters concerning the cabinet 100. However, it should be understood that the control center 112 can be used to monitor various parameters concerning multiple cabinets 100, both proximate to and remote from the control center 112.

To access the cabinet 100 in some embodiments, the user swipes an identification card (not shown) through the identification device 152 or enters a user identification code and/or a password into the control center 112 via the keyboard 148. If the user has the proper rights, the video display 144 displays a user interface that facilitates access to the items within the cabinet 100. In some embodiments, a graphical user interface ("GUI") displays a list of items available or another representation that facilitates the proper item choice. For example, a factory may provide a cabinet 100 that contains all of the necessary replacement parts and special tools needed to disassemble, repair, or build a particular component such as an engine or pump. In some embodiments, the GUI can also be configured to display an assembly procedure including drawings or special tools needed. When the user indicates that a step requiring a special tool has been reached, the proper drawer 104 is indicated with the corresponding LED 124 indicating the proper dispensing module from which an item is withdrawn. Thus, the cabinet 100 also acts to assure that the proper tools and parts are used to assemble a product or sub-assembly.

In use, the cabinet 100 controls access to the parts or items contained therein, tracks an identity of the user who is accessing the cabinet 100, and maintains an accurate inventory of the items. In addition, the cabinet 100 can be programmed to track project or job numbers, tool usage, or any other information desired, when items are accessed. This information can be used to aid in determining cost, waste, productivity, return of tools, or any other parameter desired. In some embodiments, the user enters some identification information, and uses a plurality of pre-selected modes to pick the desired item type and quantity at the control center 112. The control center 112 then checks the database, and releases the dispensing module 116, as will be discussed below.

Figure 2:
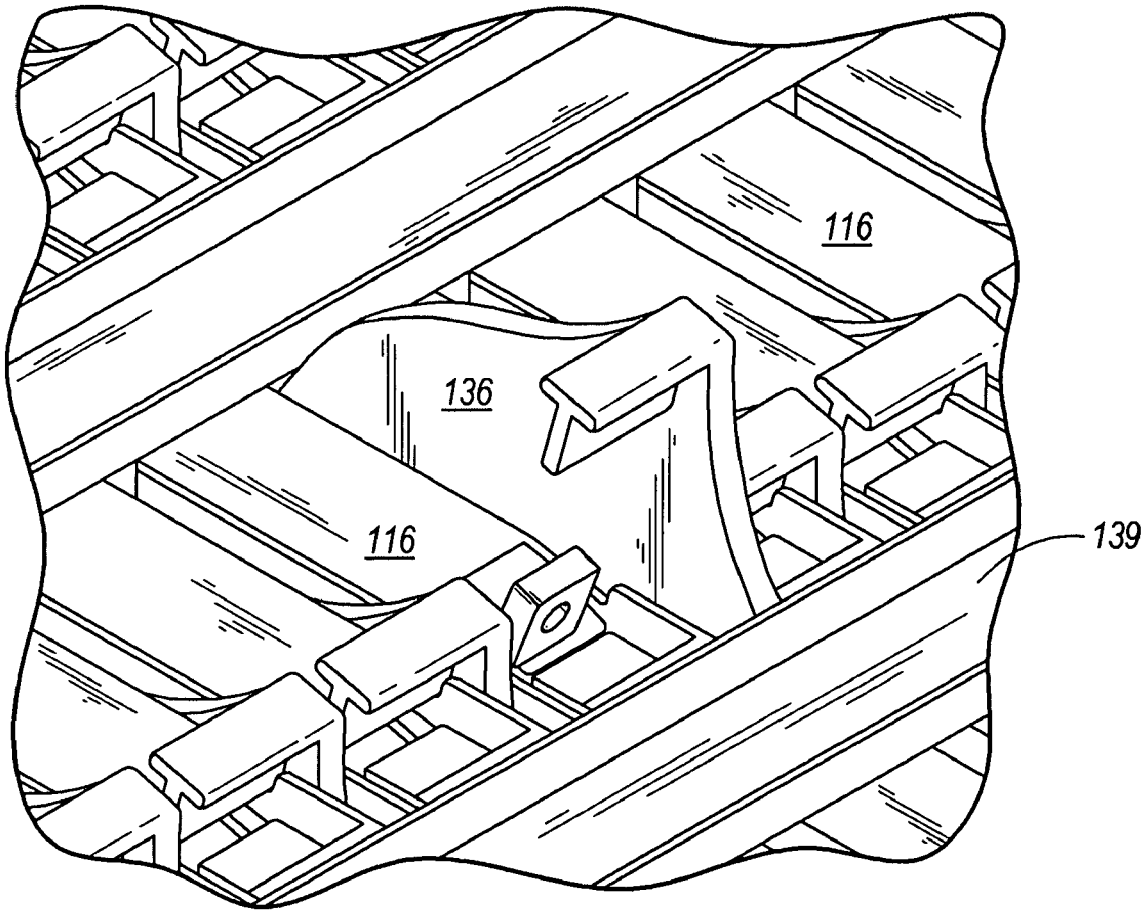
FIG. 2 shows an isometric view of a portion of the dispensing modules of FIG. 1.

To retrieve an item according to the illustrated embodiment, a user first accesses the cabinet 100. Many methods have been described and are contemplated for this step. The specific method used is dependant on the level of security desired and the cost of implementing the cabinet 100. Once accessed, a GUI is displayed that facilitates the choice of the item within the cabinet 100. Again, multiple techniques of displaying items, from a simple list to a complicated assembly drawing, are contemplated. Once the user has identified the item at the processing unit, the processing unit determines the drawer 104 in which the item is located and actuates corresponding mechanisms to unlock the particular drawer 104 and the dispensing module 116 where the item is located. FIG. 2 shows an isometric view of the dispensing module 116 held in place by the bracket 139 as shown in FIG. 1. While different dispensing modules 116 will fit in different locations of the drawer 104, correct item descriptions or item types have to be entered and inventoried by the control center 112. In some embodiments, if the user requests a quantity that is greater than one, the dispensing mechanism will be controllably actuated repeatedly for each item to be dispensed. After the dispensing mechanism has released all the items to be dispensed, the dispensing mechanism will be locked by the control center 112.

In some embodiments, the cabinets 100 or the control center 112 impose a time out period for inactivity at the cabinet 100. In some embodiments, the time out period is 60 seconds. After the time out period has elapsed, the control center 112 will relock the dispensing mechanism and the actuating handle 136. In some embodiments, the control center 112 will also indicate via the display 144 that the cabinet 100 is being locked. Error messages will also be displayed on the display 144. Information of the user that has just been identified may also be logged by the control center 112, and an alert message may be sent to the identified user using the control center 112 and the logged information.

Figure 3A:
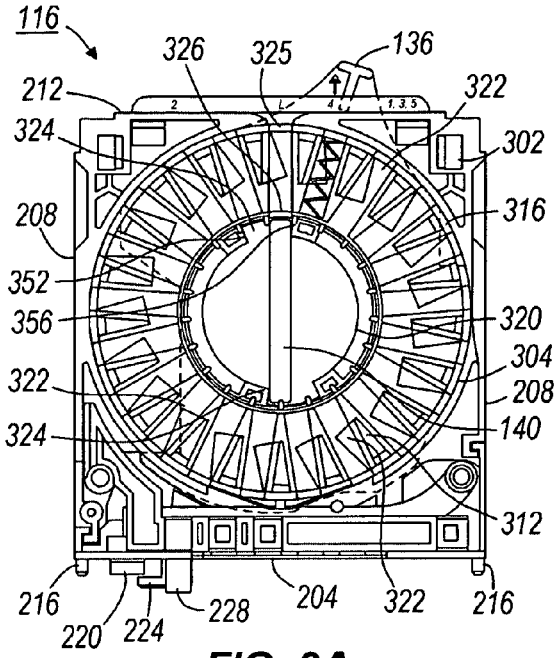
FIG. 3A shows an exemplary dispensing module of FIG. 1 in a locked position.

FIG. 3A shows an exemplary dispensing module 116 used in the cabinet 100 of FIG. 1. Although the dispensing module 116 is shown having an essentially squared housing 302, the dispensing module 116 can also be configured to have other shapes depending on the item therein and the applications at hand. The housing 302 includes a peripheral bottom 204, a plurality of peripheral sides 208, and a peripheral top 212. The housing 302 also includes a plurality of keying or alignment pins 216, a column latch 220, and a row latch 224 at the bottom 204 of the dispensing module 116. The alignment pins 216 are used to secure or position the dispensing module 116 at the bottom 156 of the drawer 104. The column latch 220 and the row latch 224 of the dispensing module 116 are used to engage or couple the dispensing module 116 to the locking mechanism of the drawer 104. The dispensing module 116 also includes a sensor flag 228 that is positioned at the bottom 204 of the housing 302. The sensor flag 228 will remain in a down position if the handle 136 is idle or has not been raised yet by the user. Although the alignment pins 216, the column latch 220, the row latch 224, and the sensor flag 228 are located at the bottom 204 of the dispensing module 116, the alignment pins 216, the column latch 220, the row latch 224 and the sensor flag 228 can also be positioned on the sides 208 in some embodiments.

The dispensing module 116 includes a round cassette 304 that includes a plurality of compartments 322, a base 312 and a cover 316 that will be discussed in detail below. The cassette 304 includes an inner cylinder 320 that includes two inner cylinder slots 324. Each of the inner cylinder slots 324 has a forward side 352 and a rearward side 356. The handle 136 of the dispensing module 116 includes an ejector 140 that moves rotationally within the inner cylinder slots 324 between the forward side 352 and the rearward side 356. The cover 316 of the cassette 304 has a first opening 325 and an inner opening 326 along the inner cylinder 320. The ejector 140 also moves radially to eject an item when the ejector is aligned with the openings 325, 326, as will be more fully discussed below.

Figure 3B:
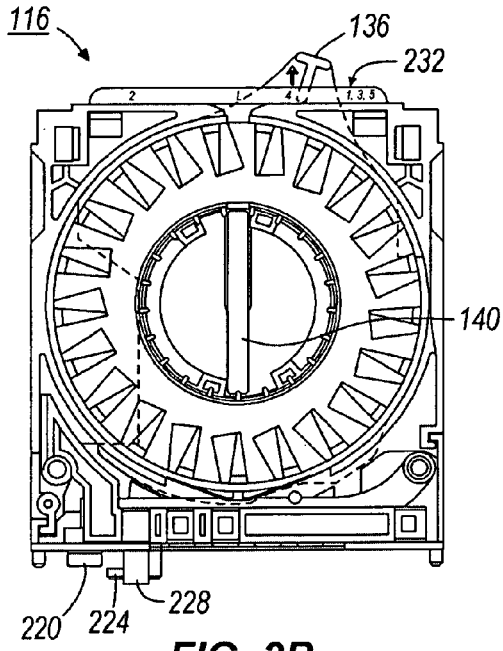
FIG. 3B shows the exemplary dispensing module of FIG. 3A in an unlocked position.

FIG. 3B shows the dispensing module 116 in an unlocked position. Once the control center 112 has identified a dispensing module 116 containing the desired item, the control center 112 sends a signal to the dispensing module 116 to unlock the locking mechanism of the drawer 104, and moves or releases the column latch 220 and the row latch 224. In this way, the handle 136 of the dispensing module 116 containing the desired item can be moved and engage the base 312 to start dispensing the desired item. The dispensing module 116 is thus in an unlocked position. The sensor flag 228 will remain in the down position until the handle 136 has been raised or lifted. FIG. 3B also shows that the handle 136 rests at a first idle position 232.

Figure 3C:
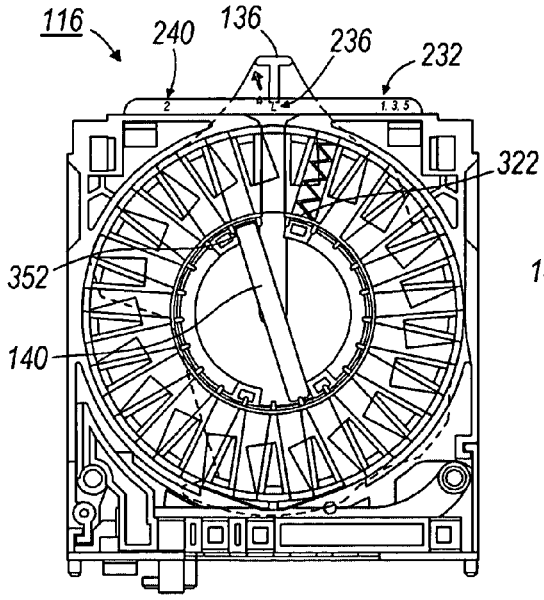
FIG. 3C shows the exemplary dispensing module of FIG. 3A in a release position.

FIG. 3C shows the dispensing module 116 in a released position. Once the user has located the dispensing module 116 containing the desired item, the user then moves the handle 136 from the first position 232 to an intermediate position 236 such that the ejector 140 pushes, moves, or rotates the forward side 352 of the inner cylinder slots 324, thereby rotating the cassette 304 in a counter-clockwise direction. In this way, the compartment 322 containing the desired item can be rotated toward a dispensing position 244 to be dispensed.

Figure 3D:
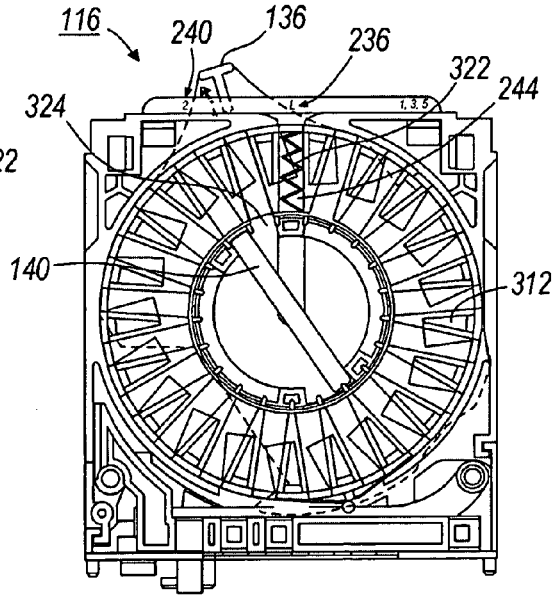
FIG. 3D shows the exemplary dispensing module of FIG. 3A in a retracted position.

FIG. 3D shows the dispensing module 116 in a retracted position. When the handle 136 moves from the intermediate position 236 to a second position 240, the base 312 of the cassette 304 moves to the dispensing position 244 where the compartment 322 containing the desired item is essentially below the intermediate position 236. Hinged dogs (not shown) in the dispensing module 116 then engage the base 312 of the cassette 304 such that the base 312 is kept from returning to the position shown in FIG. 3C as the handle 136 and the cover 316 are moved from the second position 240 back to the intermediate position 236, as discussed below.

Figure 3F:
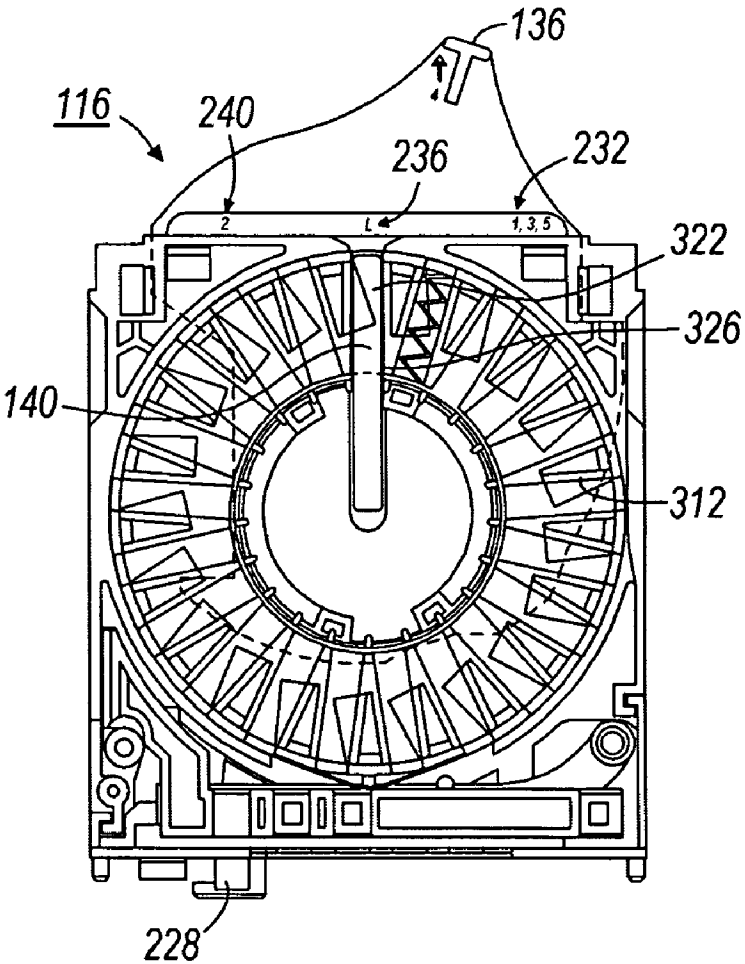
FIG. 3F shows the exemplary dispensing module of FIG. 3A in a vend position.
Figure 3E:
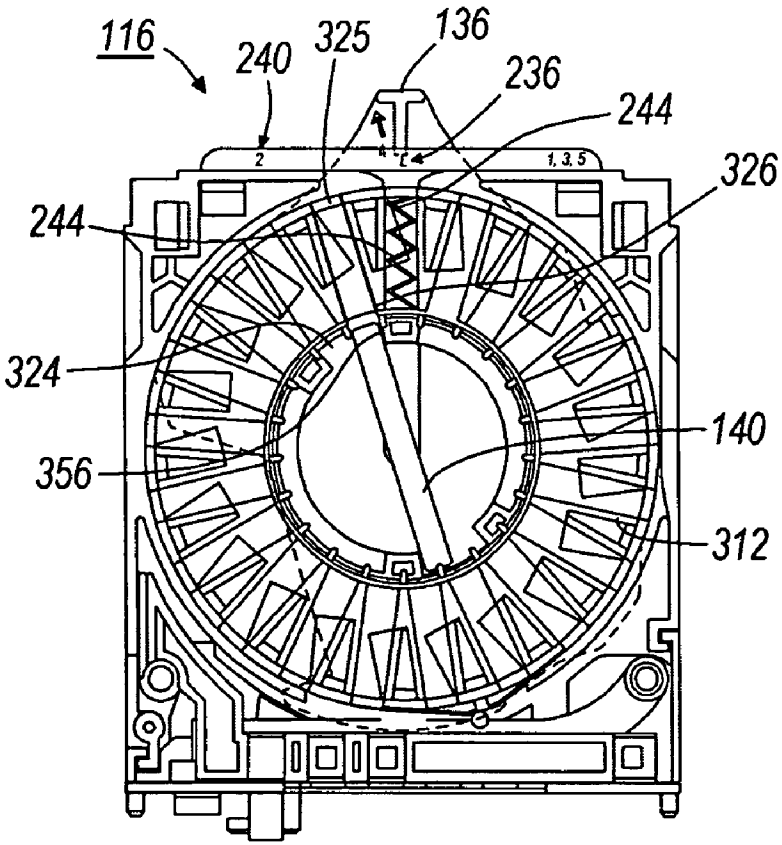
FIG. 3E shows the exemplary dispensing module of FIG. 3A in a returning position.

FIG. 3E shows the dispensing module 116 in a returning position in that the handle 136 of the dispensing module 116 is returned from the second position 240 to the intermediate position 236. As the handle 136 returns from the second position 240 to the intermediate position 236, the ejector 140 rotates the cover 316 by pushing the rearward side 356 of the inner cylinder slot 324 while the hinged dogs of the dispensing module 116 hold the base 312 stationary with the desired item to be dispensed in the dispensing position 244. The desired item to be dispensed was moved into the dispensing position 244 in line with the openings 325 and 326 in the cover 316 when the handle 136 was moved from its position as shown in FIG. 3C to its position as shown in FIG. 3D.

FIG. 3F shows the dispensing module 116 in a vending position. FIG. 3F shows that the handle 136 has been moved from the intermediate position 236 back to the first position 232, and is being lifted or raised out of the base 312. As the user raises the handle 136 from the dispensing module 116, the ejector 140 is also raised through the inner opening 326 to lift the item from the compartment 322 and out of the dispensing module 116. Also, as the handle 136 is raised the sensor flag 228 is also raised to signal to the control center 112 that a dispensing process has occurred. In turn, the control center 112 activates the locking mechanism of the dispensing module 116 and the drawer 104 such that additional vending is inhibited until the handle 136 is again moved through the steps shown in FIGS. 3A-3F. That is, if additional items from the same dispensing module 116 are required by the user, the dispensing mechanism can be unlocked as described, and the dispensing process can be repeated by moving the handle 136.

Figure 4A:
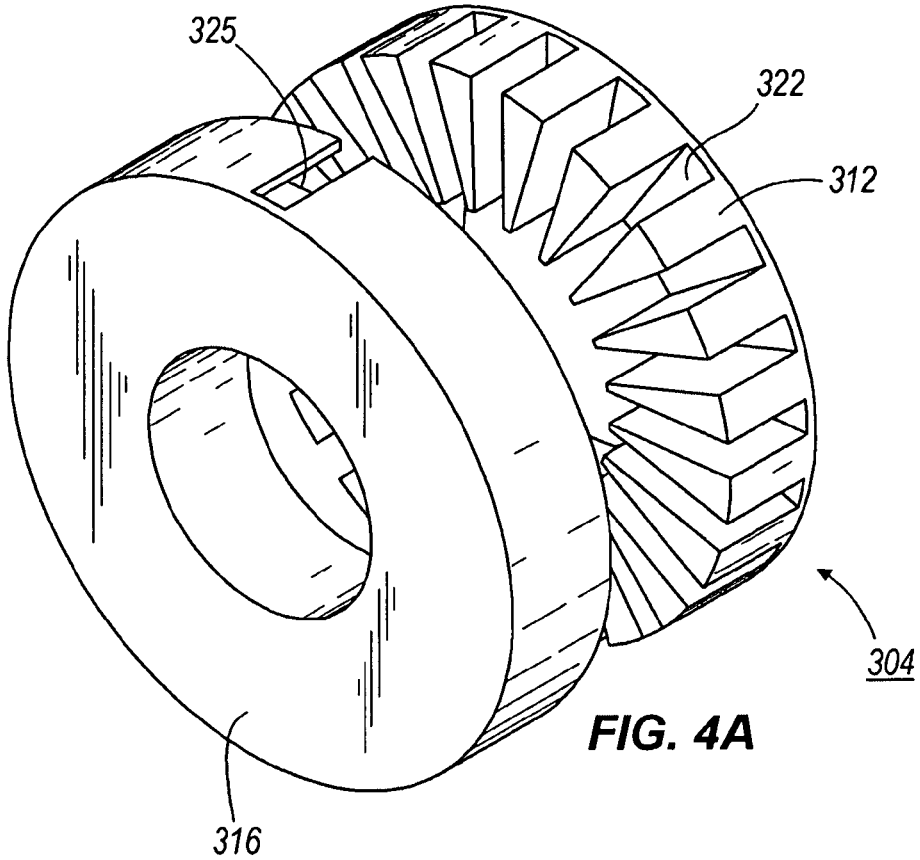
FIG. 4A shows an exploded view of a cassette positioned in the exemplary dispensing module of FIG. 3A.
Figure 4B:
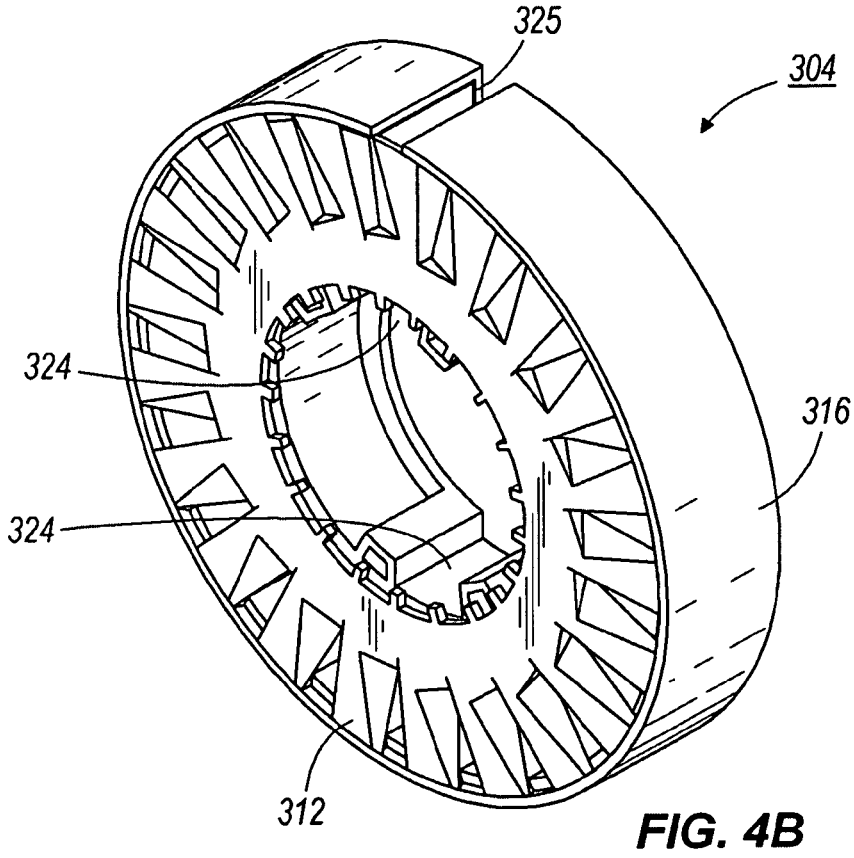
FIG. 4B shows a rear view of the cassette of FIG. 4A.

FIG. 4A and FIG. 4B show an exploded view and a rear view, respectively, of the cassette 304. The cassette 304 includes a base 312, and a cover 316. FIG. 4B shows the rear view of the base 312 and the cover 316 in a closed position. As shown in FIG. 4A, the base 312 has a number of slots, or compartments 322. Each of the compartments 322 can be used to store at least one item, although the quantity of items can be determined by the user. The cover 316 is configured like an inverted tube-style baking pan, and snaps over the base 312 to hold in position the items in the compartments 322. In the embodiment shown in FIG. 1, the base 312 is generally rotatable about the axes 164 (FIG. 1) that are parallel to the bottom plane 160 defined by the bottom 156 of the drawer 104 (FIG. 1). However, the cassette 304 can also be rotatable about the second axes 168 that are also parallel to the bottom plane 160.

The slots or the compartments 322 of different dispensing modules 116 or within the same dispensing module 116 can have different sizes. The cassette 304 shown in FIGS. 4A and 4B has twenty one compartments. The cassette 304 can therefore hold at least twenty items in sequential order in sequential locations, with the twenty-first compartment being left empty when the cassette 304 is loaded. In this way, the compartment 322 that is exposed when the dispensing module 116 is in its initial position (shown in FIGS. 3A and 3B) is empty and a user must go through the dispensing process as described above to receive an item.

Generally, the compartments 322 have the same size in a cassette 304. However, in some other embodiments, depending on the particular application, the size of the compartment 322 can also be configured differently. In some embodiments, each of the compartments 322 can have a size of about 0.7 inches by about 0.7 inches by about 0.2 inches. Furthermore, the compartments 322 can also be configured to accommodate different item shapes such as square, rectangular, polygonal, round, triangular, diamond, and other irregular-shaped items. In some embodiments, the cassette 304 can be fully or partially loaded with the same or different items.

In the illustrated embodiment, because each dispensing module 116 (and the corresponding cassette 304) can hold at least twenty items, and each drawer 104 holds at least sixty four dispensing modules 116, each drawer can hold at least 1,280 different items. In practice, however, it is likely that each cassette 304 of each dispensing module 116 holds a quantity of the same items. Several of the dispensing modules 116 in the drawer 104 can also contain the same items. The items, therefore, will likely be managed with multiple instances of the same item type at different locations.

As shown in FIGS. 4A and 4B, the cover 316 is generally configured to cover or enclose the base 312 in the closed position. When in the closed position as shown in FIG. 4B, the cover 316 covers or encloses all the compartments 322 of the base 312 except for the peripheral opening 325 on a peripheral side of the cover 316 and the inner opening 326 (FIG. 3A) on the inner cylinder 320 of the cover 316.

As the base 312 and the cover 316 rotate relative to one another, the items are free to move and slide in the corresponding compartments 322. However, the items are generally protected from contact with hard surfaces and each other by the wall separating the compartments 322. The cassettes 304 are typically semi-consumable items that are suitable for a number of reuses. As a result, some of the cassettes 304 may wear out or may be recycled. In some embodiments, the cassettes 304 can also become carriers for items that are pre-loaded at a central facility or a point of manufacture, thereby permitting rapid restocking of the cabinet 100.

As described earlier, each cassette 304 can contain a quantity of the same items, although the quantity and the item type might vary depending on stocking and facility requirements. Each of the cassettes 304 can also be partially loaded. In some embodiments, items to be dispensed are typically loaded, stocked, or stored in consecutive compartments, pockets, or slots in the cassette 304, while the items can also be randomly stocked in different compartments 322.

Figure 5A:
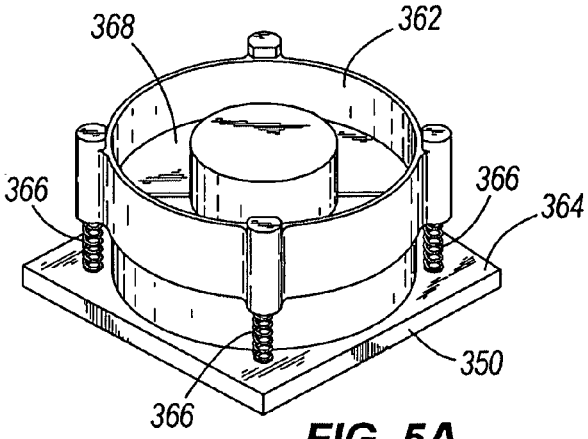
FIG. 5A shows an exemplary refill fixture.

FIGS. 5A to 5F show an item loading process. Particularly, FIG. 5A shows a refill fixture 350 that is empty and which is positioned to receive an empty base 312 into which items are loaded. The refill fixture 350 has a movable ring 362 that is coupled to a stationary fixture base 364 with a plurality of springs 366. The stationary fixture base 364 also includes a platform 368 on which the empty base 312 is positioned.

Figure 5B:
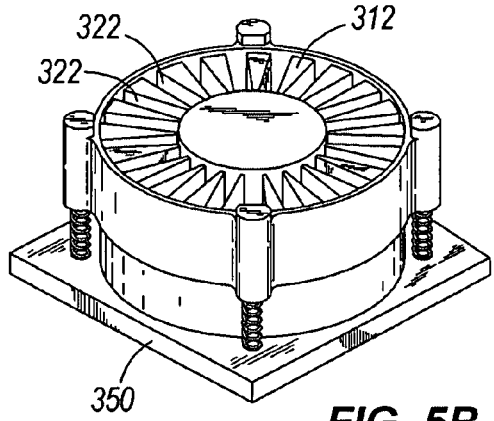
FIG. 5B shows the refill fixture of FIG. 5A with an empty cassette base.
Figure 5C:
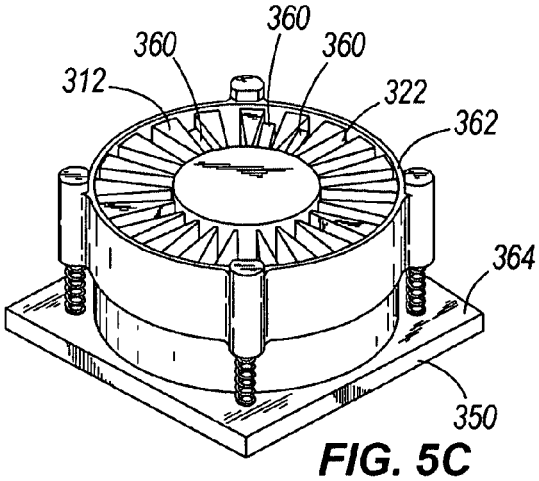
FIG. 5C shows the base having a plurality of items.
Figure 5D:
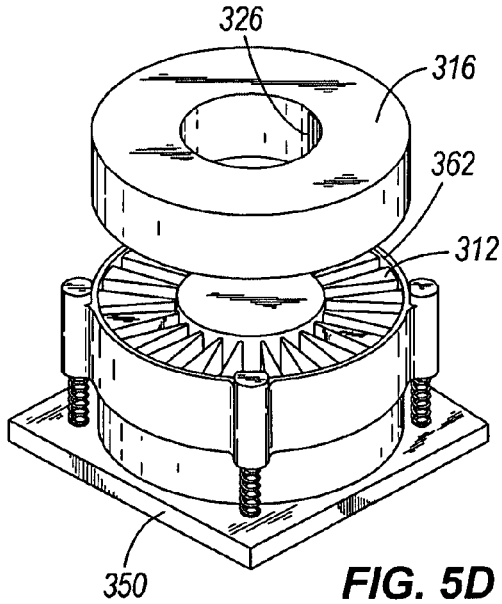
FIG. 5D shows a cover being aligned with the base and the refill fixture.

FIG. 5B shows the refill fixture 350 with the empty cassette base 312 positioned on the platform 368 inside the movable ring 362. Once the base 312 has been positioned within the movable ring 362 of the refill fixture 350, items 360 can be loaded into the compartments 322 of the base 312, as shown in FIG. 5C. Although the cassette base 312 is shown only partially loaded with items 360, the cassette base 312 can also be fully loaded with items. Once the cover 316 is aligned with the base 312 and the refill fixture 350 as shown in FIG. 5D, the cover 316 is moved to cover the movable ring 362 of the refill structure 350 such that a first dispensing position is aligned with the openings 325, 326 (FIG. 3A). In some embodiments, the individual items can be loaded into the cassette 304 by hand, but the individual items can also be loaded into the cassette 304 in the refill fixture 350 automatically.

Figure 5E:
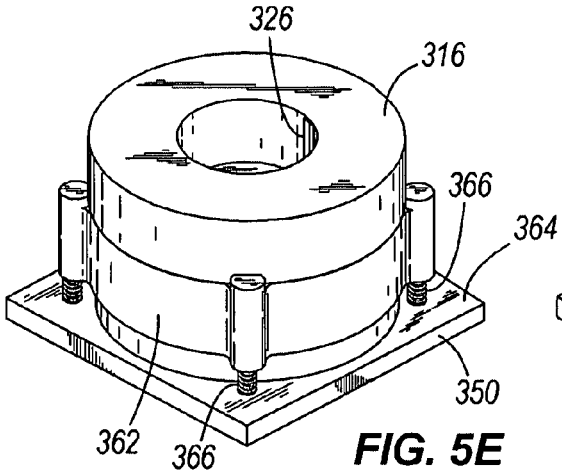
FIG. 5E shows the cover being attached to the refill structure.
Figure 5F:
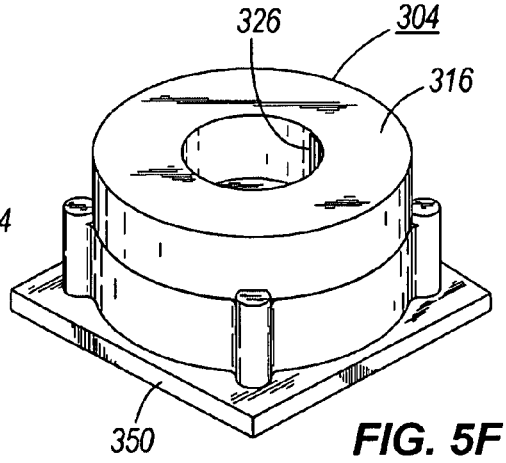
FIG. 5F shows a refilled cassette having the cover snapped into the refill fixture.

FIG. 5E shows the cover 316 being moved into position to cover the base 312. Particularly, as the cover 316 and the movable ring 362 are being pushed downward toward the stationary fixture base 364 with the platform 368 being stationary and the springs 366 being compressed, the loaded base 312 is moved up into the cover 316. Thereafter, as the loaded base 312 is fully within the cover 316, the cover 316 snaps over the base 312. The base 312 is then fully snapped within the cover 316 and the loaded cassette 304 can be removed from the refill fixture 350.

In some embodiments, to load or unload items from the cassette 304, the user enters some identification information into the control center 112 and unlocks the bracket over the dispensing module 116 in the drawer 104. The user then removes the dispensing module 116, removes the cassette 304, and either checks the inventory, replaces the cassette 304 with a fully loaded cassette 304, or returns the cassette 304 to the vending position 244 (FIG. 3D) and replaces the cassette 304 back into the housing 308 of the dispensing module 116. The user can also select from the display 144 a cassette location, and perform a refill operation reflecting a difference between a newly restocked inventory and the items remaining when the cassette 304 was initially removed. If the items or the item types inside the cassette 304 are changed, the user can perform a reclaim operation at the display 144 at the control center 112 followed by a refill operation to redefine the locations of the items and the inventory level of the item. In some embodiments, the reclaim operation and the refill operation can be combined into a single operation. The user then lowers the dispensing modules 116 back into the drawer 104. When finished, the user secures the bracket 139 to the drawer 104.

Furthermore, when restocking or servicing of the dispensing modules 116 is required, the locking bracket 139 can be opened or removed, and the individual dispensing modules 116 can be removed. Once the dispensing module 116 has been removed from the drawer 104, the cassette 304 can be removed from the dispensing housing 308. When the cassette 304 is to be replaced or refilled, the cassette 304 is generally placed, or positioned in the dispensing module 116 such that a first position containing an item is in a "ready to dispense" position, or the dispensing position. Successive items can be placed in consecutive compartments 322 of the base 312. Restocking of the cassette 304 can also be done with a machine by placing individual items in the compartments 322 one at a time or by using a restocking jig to open and release all of the compartment positions one at a time. In some embodiments, the restocking procedure can be automatically performed.

What is claimed is:

1. A dispensing system for dispensing items, the system comprising:

a base defining a base plane, having first and second compartments, and being rotatable about an axis perpendicular to the base plane, at least one of the first and second compartments configured to store an item;

a cover configured to cover the base and operable to rotate relative to the base, the cover covering the first and second compartments and having an opening;

a handle coupled to the base and configured to actuate the base to rotate about the axis to align one of the first and second compartments with the opening; and an ejector coupled to handle and configured to eject the item from the compartment after the handle aligns the ejector with the opening.

2. The dispensing system of claim 1, wherein the handle further comprises an indicator configured to illuminate when the item in the corresponding base has been selected.

3. The dispensing system of claim 1, wherein the first and second compartments have same dimensions.

4. The dispensing system of claim 1, further comprising a module housing configured to house the base and the cover.

5. The dispensing system of claim 1, wherein the ejector is configured to eject items from corresponding compartments sequentially.

6. A dispensing system for dispensing items, the system comprising:

a drawer having a bottom defining a bottom plane;

a dispensing module configured to be latched in the drawer;

a cassette configured to hold an item, and to be positioned in the dispensing module; and a handle coupled to the cassette and configured to be actuated to rotate the cassette about an axis parallel to the bottom plane, to move the item into a dispensing position when roated, to lift the item from the dispensing module when actuated and when the item is in the dispensing position, and to lock the item in the cassette of the dispensing module when left idle.

7. The dispensing system of claim 6, further comprising an indicator positioned on the drawer.

8. The dispensing system of claim 6, wherein the cassette comprises a base having a plurality of compartments in which the items are stored, and a cover configured to cover the base and to hold the items in the compartments.

9. The dispensing system of claim 8, wherein the cover comprises an opening from which the item is released.

10. The dispensing system of claim 8, further comprising an ejector coupled to the handle, and configured to eject the item from the compartment after the handle has been actuated.

11. The dispensing system of claim 6, wherein the handle further comprises an indicator configured to illuminate when the item in the corresponding cassette has been selected.

12. The dispensing system of claim 6, wherein the releasing mechanism is configured to eject items from corresponding compartments sequentially.

13. A dispensing system for dispensing items, the system comprising:

a drawer having a bottom, the bottom defining a horizontal plane;

a dispensing module configured to be latched in the drawer;

a base being positioned in the dispensing module, having first and second compartments, and being rotatable about an axis configured to be parallel to the plane, at least one of the first and second compartments configured to store an item;

a cover configured to cover the dispensing module, the cover covering the first and second compartments and having an opening; and a handle coupled to the dispensing module and configured to be actuated to rotate the base about the axis to align one of the first and second compartments with the opening and to eject the item from the dispensing module through the opening when actuated and when one of the first and second compartments is aligned with the opening, and to lock the dispensing modules in the drawer when left idle.

14. The dispensing system of claim 13, further comprising an indicator positioned on the drawer.

15. The dispensing system of claim 13, further comprising an ejector coupled to the handle, and configured to eject the item from the compartment after the handle has been actuated.

16. The dispensing system of claim 13, wherein the handle further comprises a second indicator configured to illuminate when the item in the corresponding cassette has been selected.

17. The dispensing system of claim 13, further comprising a releasing mechanism configured to eject items from corresponding compartments sequentially.

* * * * *